US008933811B2

(12) United States Patent
Højmose

(10) Patent No.: US 8,933,811 B2
(45) Date of Patent: Jan. 13, 2015

(54) SMOKE ALARM

(75) Inventor: Glenn Højmose, Silkeborg (DK)

(73) Assignee: Cavius ApS, Silkeborg (DK)

( * ) Notice: Subject to any disclaimer, the term of this patent is extended or adjusted under 35 U.S.C. 154(b) by 294 days.

(21) Appl. No.: 13/500,391

(22) PCT Filed: Aug. 10, 2010

(86) PCT No.: PCT/DK2010/050206

§ 371 (c)(1),
(2), (4) Date: Jun. 25, 2012

(87) PCT Pub. No.: WO2011/042020

PCT Pub. Date: Apr. 14, 2011

(65) Prior Publication Data

US 2012/0268281 A1 Oct. 25, 2012

(30) Foreign Application Priority Data

Oct. 5, 2009 (DK) ..... 2009 01090

(51) Int. Cl.

| | |
|---|---|
| ***G08B 23/00*** | (2006.01) |
| ***G08B 17/107*** | (2006.01) |
| ***F21V 33/00*** | (2006.01) |
| *F21S 8/06* | (2006.01) |

(52) U.S. Cl.

CPC ..... *G08B 17/107* (2013.01); *F21V 33/0076* (2013.01); *F21S 8/06* (2013.01)

USPC ..... 340/630; 340/693.5; 340/693.6; 340/693.9; 340/693.11

(58) Field of Classification Search

None

See application file for complete search history.

(56) References Cited

U.S. PATENT DOCUMENTS

| | | | | |
|---|---|---|---|---|
| 3,863,076 | A * | 1/1975 | Steele et al. | 250/574 |
| 3,916,209 | A | 10/1975 | Steele et al. | |
| 4,075,614 | A * | 2/1978 | White | 340/594 |
| 4,090,178 | A * | 5/1978 | Norris | 340/506 |
| 4,257,039 | A * | 3/1981 | Webb et al. | 340/629 |
| 4,694,285 | A * | 9/1987 | Scripps | 340/693.2 |
| 4,702,452 | A * | 10/1987 | Penar | 248/317 |
| 4,812,827 | A * | 3/1989 | Scripps | 340/693.1 |
| 4,980,672 | A * | 12/1990 | Murphy | 340/571 |
| 5,432,500 | A * | 7/1995 | Scripps | 340/628 |
| 5,555,455 | A * | 9/1996 | McGinley | 340/627 |
| 5,578,996 | A * | 11/1996 | Watson et al. | 340/628 |
| 6,492,907 | B1 * | 12/2002 | McCracken | 340/628 |
| 6,653,942 | B2 * | 11/2003 | Kadwell et al. | 340/630 |
| 6,696,967 | B1 * | 2/2004 | Rutter et al. | 340/632 |
| 6,876,305 | B2 * | 4/2005 | Kadwell et al. | 340/630 |
| 6,967,582 | B2 * | 11/2005 | Tice et al. | 340/630 |
| 7,109,874 | B2 * | 9/2006 | Pilkington | 340/628 |
| 7,504,960 | B2 * | 3/2009 | McGrath | 340/636.1 |

(Continued)

FOREIGN PATENT DOCUMENTS

| | | |
|---|---|---|
| EP | 0257325 | 3/1988 |
| GB | 1250297 | 10/1971 |
| JP | 52155587 A | 12/1977 |

*Primary Examiner* — Julie Lieu

(74) *Attorney, Agent, or Firm* — James Creighton Wray

(57) ABSTRACT

Smoke alarm comprising at least one internal chamber, which chamber has at least one opening towards the surroundings, such that air may pass through the chamber, and where means are provided for emitting light and means for detecting said light is provided in or around said chamber, where the change in light intensity registered by the means generates a smoke alarm.

9 Claims, 10 Drawing Sheets

(56) References Cited

U.S. PATENT DOCUMENTS

| | | | | |
|---|---|---|---|---|
| 7,616,126 | B2 * | 11/2009 | Kadwell et al. | 340/630 |
| 7,786,879 | B2 * | 8/2010 | Lax | 340/628 |
| 8,610,586 | B2 * | 12/2013 | Shimada et al. | 340/627 |
| 2003/0001746 | A1 | 1/2003 | Bernal | |
| 2006/0208877 | A1 * | 9/2006 | Kates | 340/539.1 |
| 2008/0018485 | A1 * | 1/2008 | Kadwell et al. | 340/630 |
| 2008/0266558 | A1 * | 10/2008 | Hess et al. | 356/338 |
| 2009/0009348 | A1 * | 1/2009 | Mizuo | 340/630 |

* cited by examiner

SMOKE ALARM

This application claims the benefit of Danish Application No. PA 2009 01090 filed Oct. 5, 2009 and PCT/DK2010/050206 filed Aug. 10, 2010, International Publication Number WO 2011/042020 A1, which are hereby incorporated by reference in their entirety as if fully set forth herein.

FIELD OF THE INVENTION

The present invention relates to smoke alarms, having a smoke detector.

BACKGROUND OF THE INVENTION

In the art there are a number of known smoke detectors which are able to sound an alarm should it detect smoke. One of the main problems with the smoke detectors in the art is that they are very bulky. The bulkiness arises due to the fact that in order to achieve a cheap construction with a certain reliability it is necessary to provide a rather large smoke detection chamber. A rather large smoke detection chamber requires for those types of smoke detectors which rely on optical detection that the light source is rather intensive in order to be able to beam the light beam from the light emitting device, the light being deflected off the smoke particles to the light detector. This in return requires a rather bulky battery. Most smoke detectors of this type therefore require that the battery is exchanged every year or so. Often the battery exchange is not carried out and the electronic circuitry in the smoke alarm will register low voltage and will then emit a very loud (and annoying) sound signal indicating that the battery is not up to the required power level. Instead of replacing the battery many users demount the smoke detector altogether and remove the battery in order to avoid the annoying sound signal. Of course, the intention is to replace the battery at some future point in time and remount the smoke alarm but experience indicates clearly that in many cases the smoke alarms are never reinstalled properly.

The relatively bulky dimensions of the known smoke alarms furthermore make them undesirable within most homes in that their design very seldom add to the interior decoration scheme.

OBJECT OF THE INVENTION

It is an object of the invention to provide an ultra compact and reliable smoke detector and alarm, which alarm has an extremely long effective service life.

A further object is to provide a smoke detector which is compact and thereby less noticeable in the interior decoration scheme, and in particular a smoke detector which may be integrated in common electrical outlets.

These and other objects are achieved by a smoke detector and alarm according to claim 1.

Further advantages are provided by the embodiments of the invention disclosed in the sub-claims.

DESCRIPTION OF THE INVENTION

The smoke detector is of the optical type where a light source emits light towards the light sensitive diode, and if the light intensity changes, this is an indication of smoke being present in the field between the light emitter and the light detector. This will cause the smoke alarm to be activated. Other types of smoke detectors may also be used, for example radioactive detectors.

The smoke detector will activate the audible alarm and/or the visible alarm for example in the shape of stroboscopic lights such that in addition to indicating to the user of the device that there is a smoke hazard and thereby awakening the user, it will also provide the user with guidance to where the portable personal alarm device is situated in the room. This is important in that for example if the device is used in a hotel, the portable personal alarm device may be attached to the door and by alerting the user to the presence of smoke and at the same time creating a stroboscopic light, it will guide the user towards the door and thereby a possible escape route.

The smoke detection means may further comprise a further light detection device such that the smoke detector means may compensate for the presence of ambient light which causes traditional smoke detector means to trigger at inconvenient times. If there is a sudden change in the ambient light, this may give rise to a false alarm signal which is very inconvenient for a user. The sudden changes in light may occur for example where a user staying in a hotel room close to flashing neon signs or roads and the like where headlights from cars may give sudden flashes in a room where the user is staying. Furthermore, as the personal alarm device is portable and therefore may be carried in a bag or pocket, the device may be programmed such that the smoke detector is armed even without the user being aware of this. As the bag is opened or the user enters the dark room or leaves the dark room into a room with very much light, this may trigger the portable personal alarm device which may be very inconvenient for the user.

By programming the control circuit such that it will compensate for ambient light by means of having a further light detecting device outside the smoke detector means, all these inconvenient situations may be avoided.

The control circuit may comprise a power monitoring circuit such that an alarm, either audible or visible, is generated when the power level is below a certain predefined limit. The alarm or the indication by flashing the LEDs or for example changing the colour of the LEDs will indicate to a user that it is necessary to replace or recharge the power source. In some embodiments, it is foreseen that the power source is rechargeable and is therefore provided with an interface such that for example the same type of charger which is used for mobile phones may be used in order to recharge the power source of the portable personal alarm device. In some cases, the power supplied by the charging device is not sufficient and the control circuit is in these instances provided with converters such that the power transferred to the rechargeable power source is converted to the correct voltage.

In particular in combination with the smoke detector means and the audible/visible alarm indication means, the flashlight option may come in very handy. For example if a fire has broken out in a lodging, the portable personal alarm device will detect this by the smoke detector means. This will cause the audible and/or visible alarm indication means to set off a loud noise and possibly at the same time a stroboscopic light. For the user, this will make it possible easily to detect the whereabouts of the device although smoke may be disorienting the user, the stroboscopic light will guide the user towards the device. Once the user has retrieved the device, the flashlight option will make it easier for the user to find his way towards the fire escape. Therefore, the functionality of having a flash light built into the device may turn out to be a very useful option for such a portable personal alarm device.

An electrical outlet for a light fixture is integrated a smoke alarm. The electrical outlet in particular is a light fixture suitable to be mounted in a ceiling or other surface from which electrical equipment and in particular lamps and the like are suspended. The electrical outlet includes a covering. The smoke alarm is comprised within the housing which may be installed in most rooms having electrical outlets, without being obtrusive to the room as such.

By integrating the smoke alarm inside the covering of the electrical outlet, the smoke alarm as such is not visible and therefore does not contribute something "new" inside the room. In most buildings the electrical installations are arranged in pipes, which pipes are provided with connection boxes where light fixtures, switches etc. are to be positioned. By providing space inside the covering for the very small and compact smoke alarm, as will be discussed below, the otherwise empty space will be used for a practical purpose.

In addition to having the smoke detector means, the device may also have gas detection means. The gas detection means are usually constructed such that they require the air containing the gas to pass by the sensor, for example a radioactive isotope which will change electrical characteristics or the like when contacted by certain gasses. For these reasons, the inventive device according to the present invention may be provided with a miniature fan of the types used in computers. Tests have indicated that the heat generated by the power source when the device is put in a substantially upright position may cause the air to move through the device in a "chimney-like" fashion such that air and possibly gas containing air will be sucked in a the bottom of the device, led past the power supply and escape the device around the switch means. This airflow is sufficient and may replace the miniature fan.

In a still further embodiment, the device may comprise a heat sensor for example in the shape of a heat sensitive resistor such that this sensor in combination with pre-programmed temperature intervals or temperature changes stored in the control circuit may generate the appropriate alarm signals. This is particularly useful for example again in the instance where the user is staying in a lodging and has attached the portable personal alarm device to the door of the lodging. Should a fire occur outside the room where the user is staying, the heat will be transmitted through the door or through the cracks in the door and thereby indicate to the device that an irregular heat increase is present and thereby activate the alarm. In this manner, the personal alarm device will indicate to the user that something unusual is amiss even though smoke has not crept through the door, the temperature increase will indicate that an alarm should be generated.

The device may also comprise a function where the alarm, both visible and audible, is shut off. This may for example be by depressing the switch means for a certain period, for example two seconds.

DETAILED DESCRIPTION OF EMBODIMENTS

Figure 1:
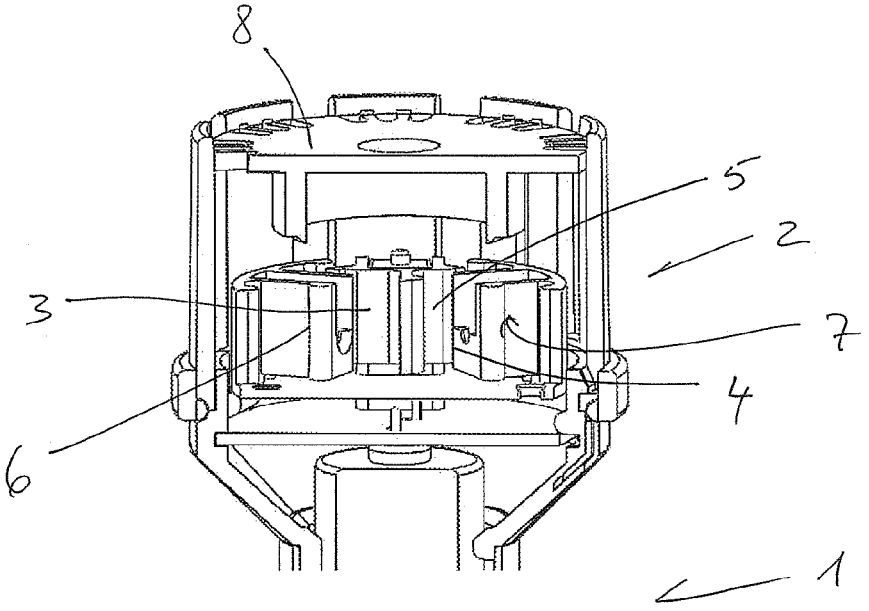
FIG. 1 illustrates a smoke alarm mounted in a general alarm device.

Furthermore in FIG. 1, a cross section through the smoke sensor device is depicted wherein the device 1 in one end is provided with a chamber 2. The chamber is a light trap, and the chamber is constructed such that a light sensor 7 is not able to detect the light emitted from a light source 6. If/when smoke enters the chamber 2, the particles will reflect the light such that the light sensor 7 will register the light and thereby activate the alarm.

The light sensor may be coupled to the micro processor such that the light intensity from the ambient light is compensated for, and only the increase in light intensity due to the reflections from the smoke particles is registered.

The chamber is in this embodiment split in two halves 3, 4 where the first half 3 is provided with apertures such that air unhindered may pass through the device in this chamber 3. Between the chamber 3 and the chamber 4, an aperture 5 is provided connecting the chamber 3 with the chamber 4. In the first chamber 3, a light source is furthermore provided, in this example in the shape of a blue diode 6 and the in the second chamber 4, a light sensor 7 is provided. The light sensor 7 will under normal circumstances register the light seeping through the aperture 5 and thereby create a reference light intensity which is stored on the micro processor. As the smoke detector is turned on as explained with reference to FIG. 2, the blue diode 5 will illuminate the chamber 3 and thereby change the light intensity which is registered by the sensor 7. As the smoke detector is activated a new reference will be established for the light intensity registered by the light sensor 7.

In an alternative embodiment, the smoke detector may work the opposite principle, i.e. register the lack of light. If smoke should enter the chamber 3, the light intensity registered by the light sensor 7 will be obscured in that the smoke will partly cloud the aperture 5 such that less light will enter the second chamber 4 and thereby be registered by the light sensor 7. This will cause the smoke detector to activate the alarm.

In this description of the embodiments being suitable to be fitted into the illustrated device, a piezo electric loudspeaker element has been selected. This is due to the fact that a piezo electric element will be able to be generated the extremely loud noise which is required in order to create an alarm signal which will serve the purposes as explained above. Another requirement is that the piezo electric element has a very shallow construction height such that it may be integrated into the bottom of the device, for example above the two chambers 3,4 indicated by 8. Finally, the piezo electric element is not very power consuming such that a prolonged alarm sound may be generated in spite of the relatively low power supply present in such a device.

In FIGS. 2-5 details of the internal chamber 2 are illustrated.

Figure 2:
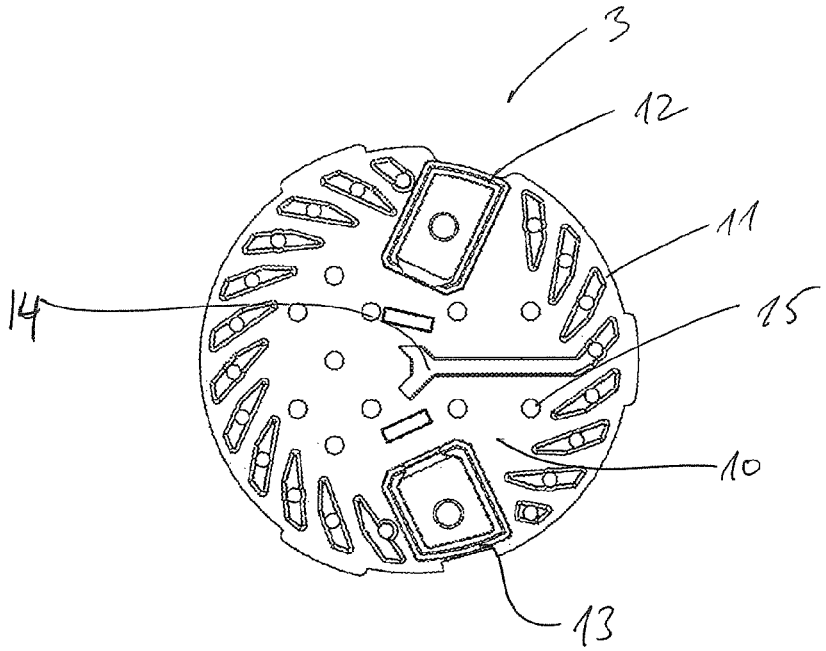
FIGS. 2 to 5 illustrate details of the internal chamber.
Figure 3:
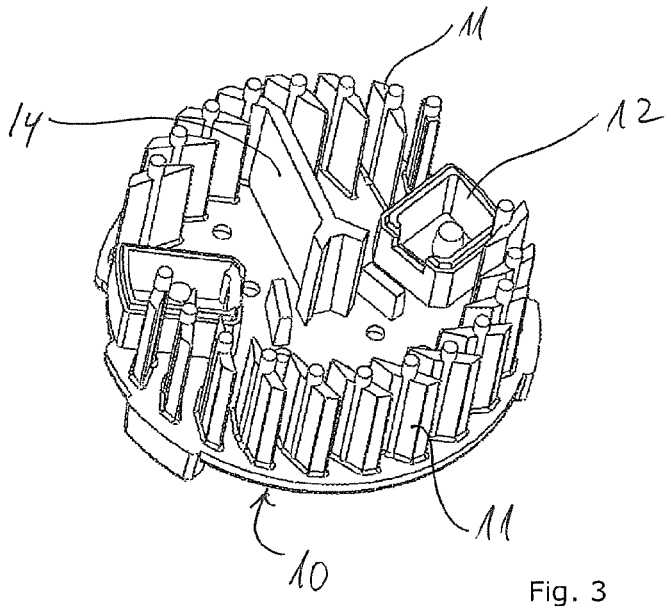
Figure 4:
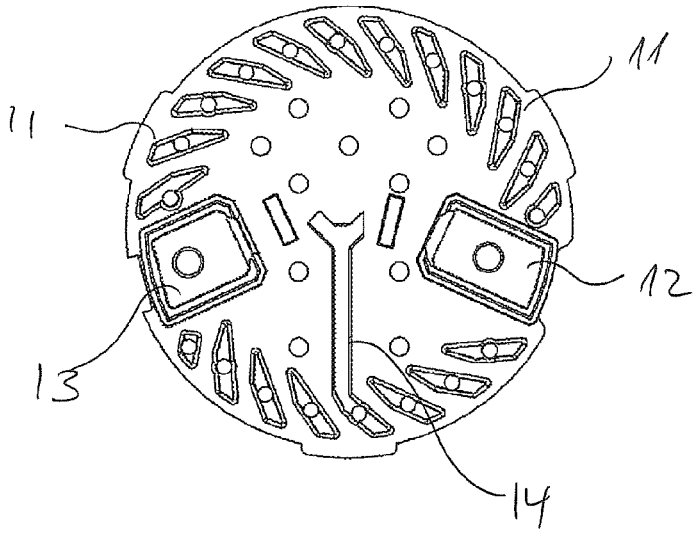

As already explained above the chamber 2 may be split into two halves 3, 4. In FIGS. 2, 3 and 4 the first half 3 is illustrated seen from various angles and in FIG. 5 the second half 4 is illustrated. The first half 3 comprises a plate member 10 on which a number of air foils 11 are provided substantially evenly distributed along the periphery of the plate member 10. As the air foils 11 substantially have a cross-sectional shape corresponding to that of an air plane wing, i.e. that on one side the air foils 11 are substantially flat whereas on the other side the air foils are provided with a curvature. The shape of the air foils is very important when it comes to designing smoke alarms of this type where it is desirable to provide a smoke chamber 2 having the smallest possible dimensions and at the same time achieving a high degree of reliability.

Furthermore the air foils 11 are angled relative to a radius of the air chamber such that as air enters between the air foils into the chamber 2 a substantially homogeneous mixture will occur inside the chamber such that the light source and light sensor will with a very high degree of reliability detect changes due to particles in the incoming air. The first half 3 is furthermore provided with two secondary housings 12, 13 which in the assemble stage of the device as will be evident with reference to FIG. 7*a* will be superposed the light source 6 and the light sensor 7 in their mounted position as illustrated with reference to FIG. 5.

Between the two housings 12, 13 is provided a wall 14 which wall serves to ensure that the light source 6 does not shine light directly to the light sensor 7 but only that light reflected into the light sensor by smoke particles will be registered by said light sensor.

In FIG. 3 is illustrated a perspective of the first half 3 in order to illustrate the arrangement of the air foils 11 along the periphery of the plate member 10.

Furthermore, in the plate member 10 are provided a number of openings 15. These openings serve to allow sound/noise generated by the alarm in the shape of a piezo electric element 20, see FIG. 7*a*, to propagate to the ambient via the chamber 2 and the openings provided between the air foils 11 and the intermediate 19 as will be explained in further details with reference to FIG. 7*a*.

Figure 5:
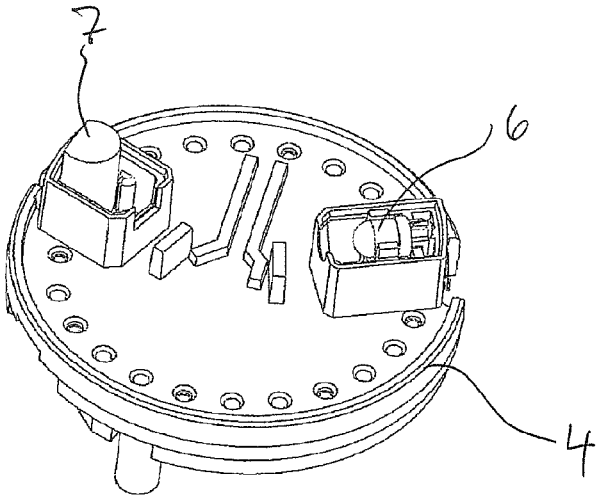

Turning to FIG. 5 it is evident that the light source and light sensor 6, 7 are arranged at an angle rather than arranged in a straight line. When arranged appropriately, i.e. such that the second half 4 is superposed the first half 3 in such a manner that the light source is superposed the sub-housing 12 and the light sensor 7 is superposed the sub-housing 13, the wall 14 will separate the light source 6 from the light sensor 7. Furthermore, by superposing the second half 4 on top of the first half 3, the height of the air foils 11 will serve to provide the correct distance and thereby create the air chamber 2.

Figure 6:
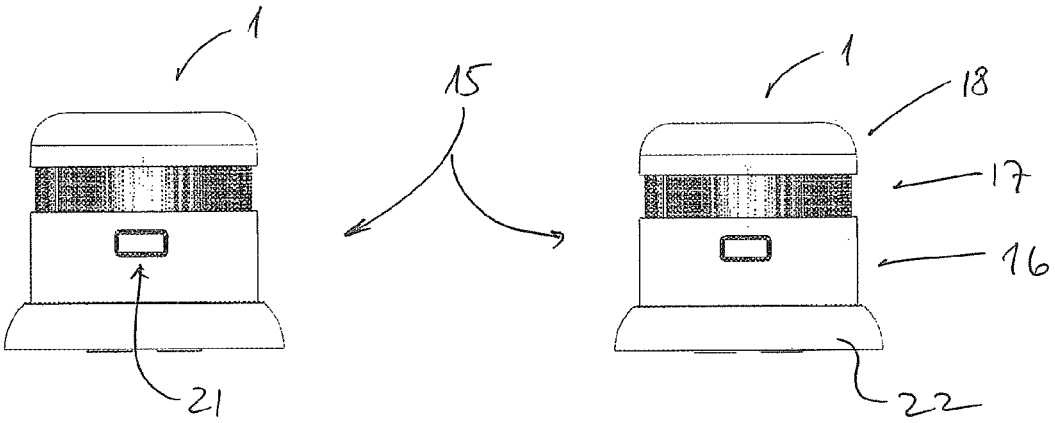
FIG. 6 illustrates the compact size of a preferred embodiment of the smoke alarm.

In FIG. 6 are illustrated two assembled smoke alarms according to a preferred embodiment of the invention where only the housing 15 of the smoke alarms 1 is visible.

The housing 15 is divided into three main sections, a lower housing section 16, an intermediate section 17, and a top section 18. In the lower housing section 16 is provided a button/indicator which button serves to test the alarm such that by pressing the button 21 the acoustic element in the shape of a piezo electronic loudspeaker, see FIG. 7*a*, will be activated. The intermediate housing section 17 is in this embodiment a mesh structure such that ambient air easily will be allowed to enter the chamber 2. The top section encapsulates the piezo electric loudspeaker/alarm element.

At the bottom is provided a holder 22 which holder is adapted to be mounted/fixed to for example a ceiling or wall. The smoke alarm 1 may hereafter be either rigidly or removably attached to the holder 22.

Figure 7A:
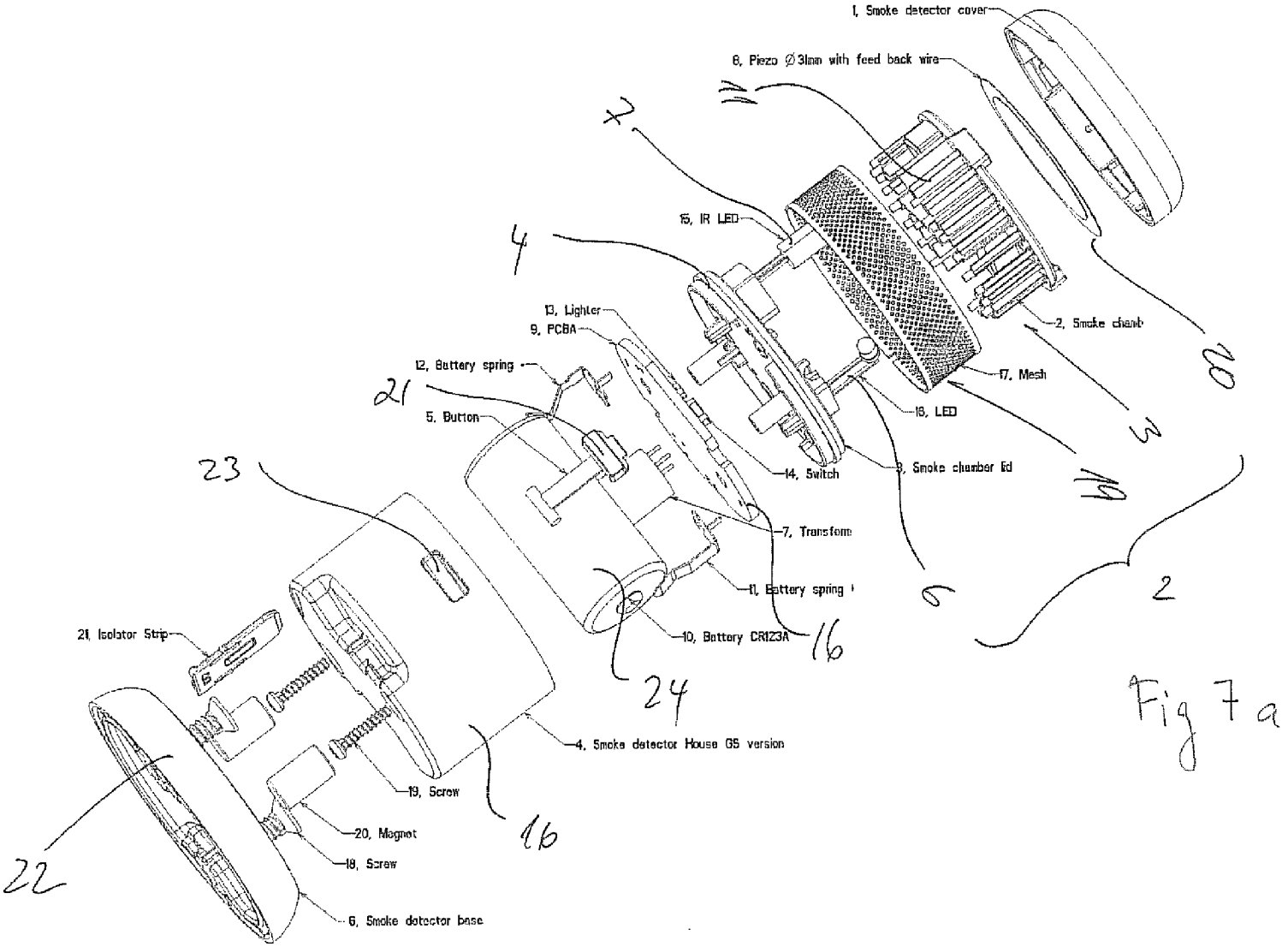
FIG. 7*a-c* illustrate an exploded view of FIG. 6, as well as dimensions.

Turning to FIG. 7*a* an exploded view of the device 1 is illustrated. As already elaborated above it is clear how the separate parts of the device are inter-arranged in order to accommodate the complicated device inside the very small integral and compact housing.

In the lower housing part 16 is provided an aperture 23 which aperture 23 allows access for the button 21 to the outside such that the button may be served by the user without taking the device apart. Furthermore, in the lowermost part of the housing 16 the source of energy, in this instance a battery 24, is located. In order to control the various functions of the smoke alarm various electronic circuitry is necessary and this circuitry is arranged on a PCB 25 interposed between the lowermost housing 16 and the chamber 2.

For the sake of clarity wiring and other necessary electrical components are not illustrated but it is clear that these are trivial items and are by reference integrated in the device.

Figure 7B:
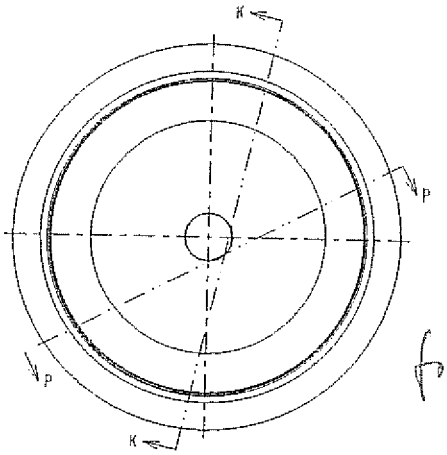
Figure 7C:
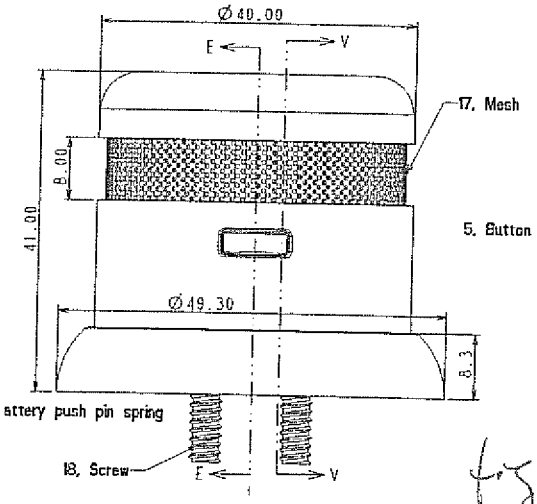
Figure 8:
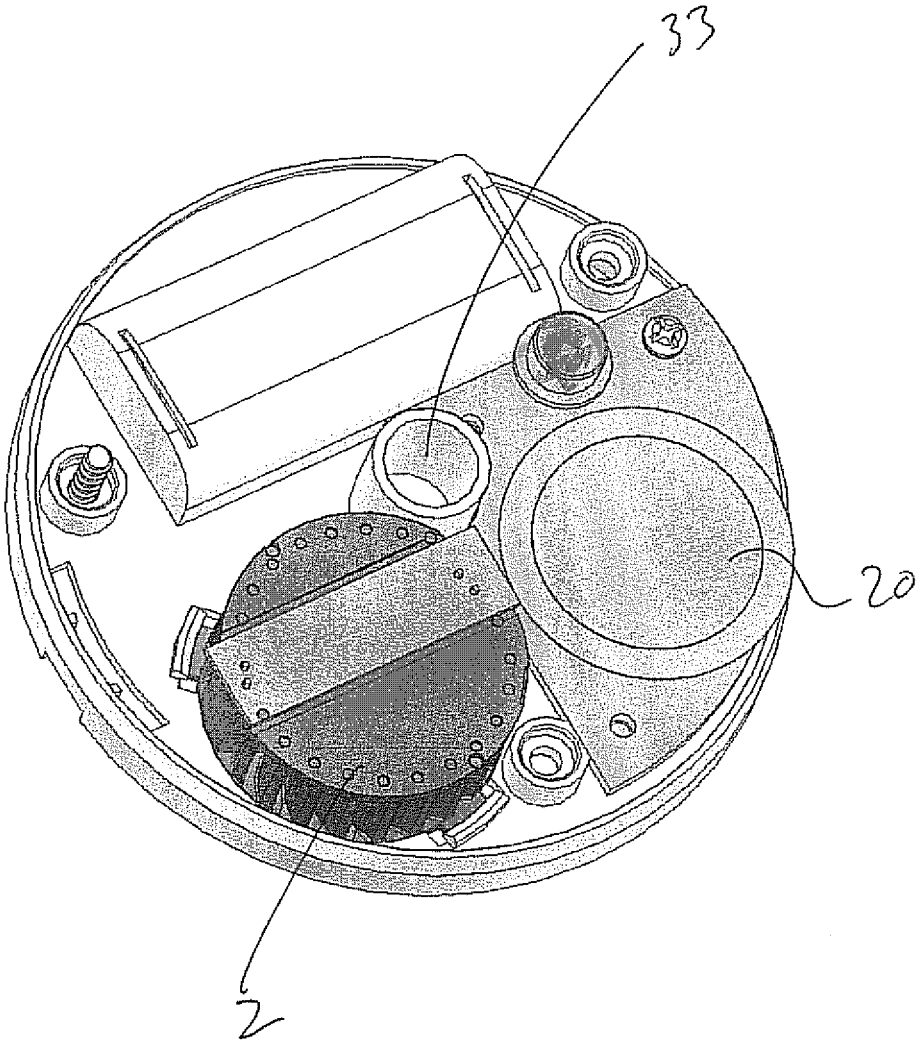
FIG. 8-11 illustrate an alternative embodiment where the smoke alarm is integrated into an electrical outlet.

Turning to FIGS. 7*b* and 7*c* the relatively small dimensions of the device are illustrated in order to emphasize that with the present invention it has been possible due to the inventive design of the internal chamber 2 to provide a very compact device which by grace of the design of the air foils and the internal chamber 2 still provides high reliability.

In FIGS. 8-11 is illustrated an embodiment of the invention where the compact design of the chamber 2 is used in order to integrate the smoke alarm into an electric light fitting such as for example light fittings arranged in ceilings in order to suspend lamps or other electrical devices.

Figure 9:
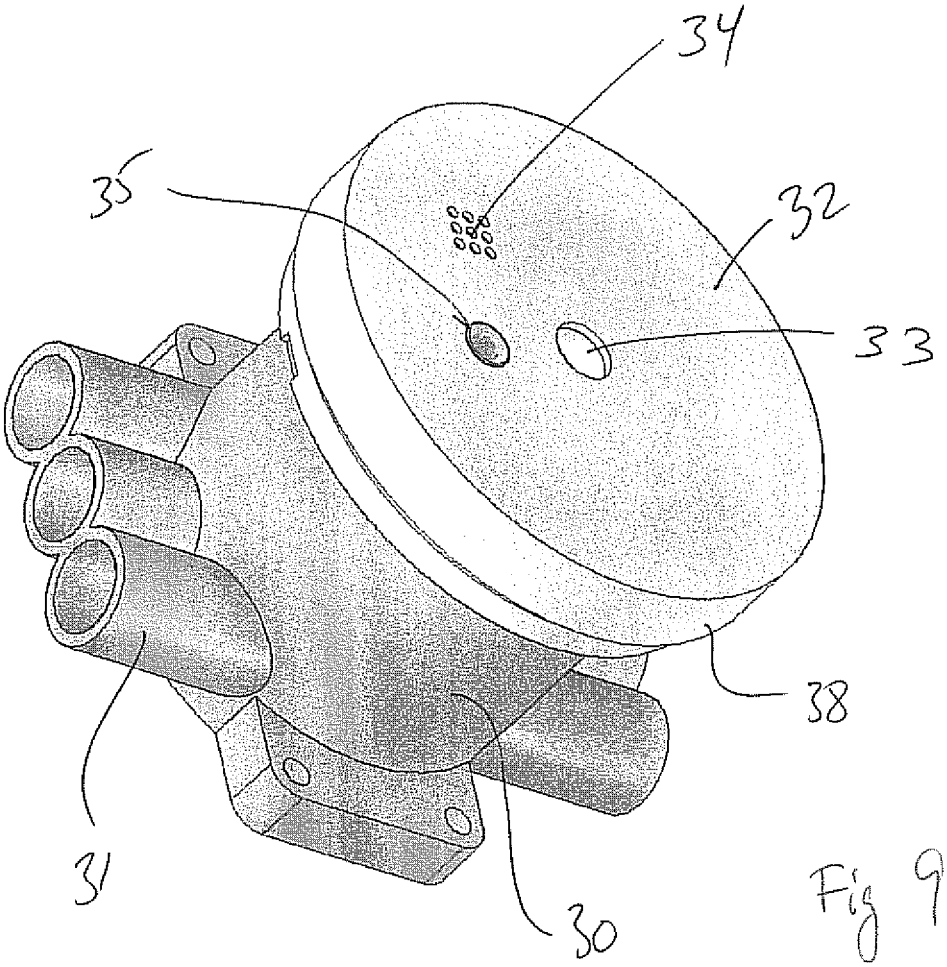

The light fixture as such is usually arranged in a cable installation box 30 as illustrated in FIG. 9. The box 30 comprises lead-ins 31 which by appropriate piping or cabling may be connected to a source of energy. On top of the installation box is usually arranged a cap in order to shield the surroundings from the electrical connections such that only an electrical wire (not illustrated in any of the embodiments) may penetrate through a central opening. By enlarging the cap slightly it has become possible to integrate the smoke alarm in this cap such that it is possible to arrange the smoke alarm quite inconspicuously in connection with ordinary light fixture.

As illustrated in FIGS. 8-11 the light fixture comprises a cap 32. In the cap 32 is provided an opening 33 allowing the electrical wire connected to the lamp or other suspended article to pass through the smoke alarm. The cap 32 is furthermore provided with a number of apertures 34 such that air may be allowed to enter the smoke chamber 2 of the smoke alarm device. Furthermore a test button 35 is provided in the cap. In the embodiment illustrated in FIGS. 10 and 11 the suspended electrical devices such as lamps and the like are connected to the electrical grid by means of a jack which jack fits into the socket 36 provided in the cap. Furthermore the socket 36 also serves to take the weight off the device suspended from the light fixture.

It is clear that the installation box 30 and the lead-ins 31 will be hidden behind the ceiling such that only the cap and the sides of the cap 38 will be visible on the ceiling itself.

Figure 10:
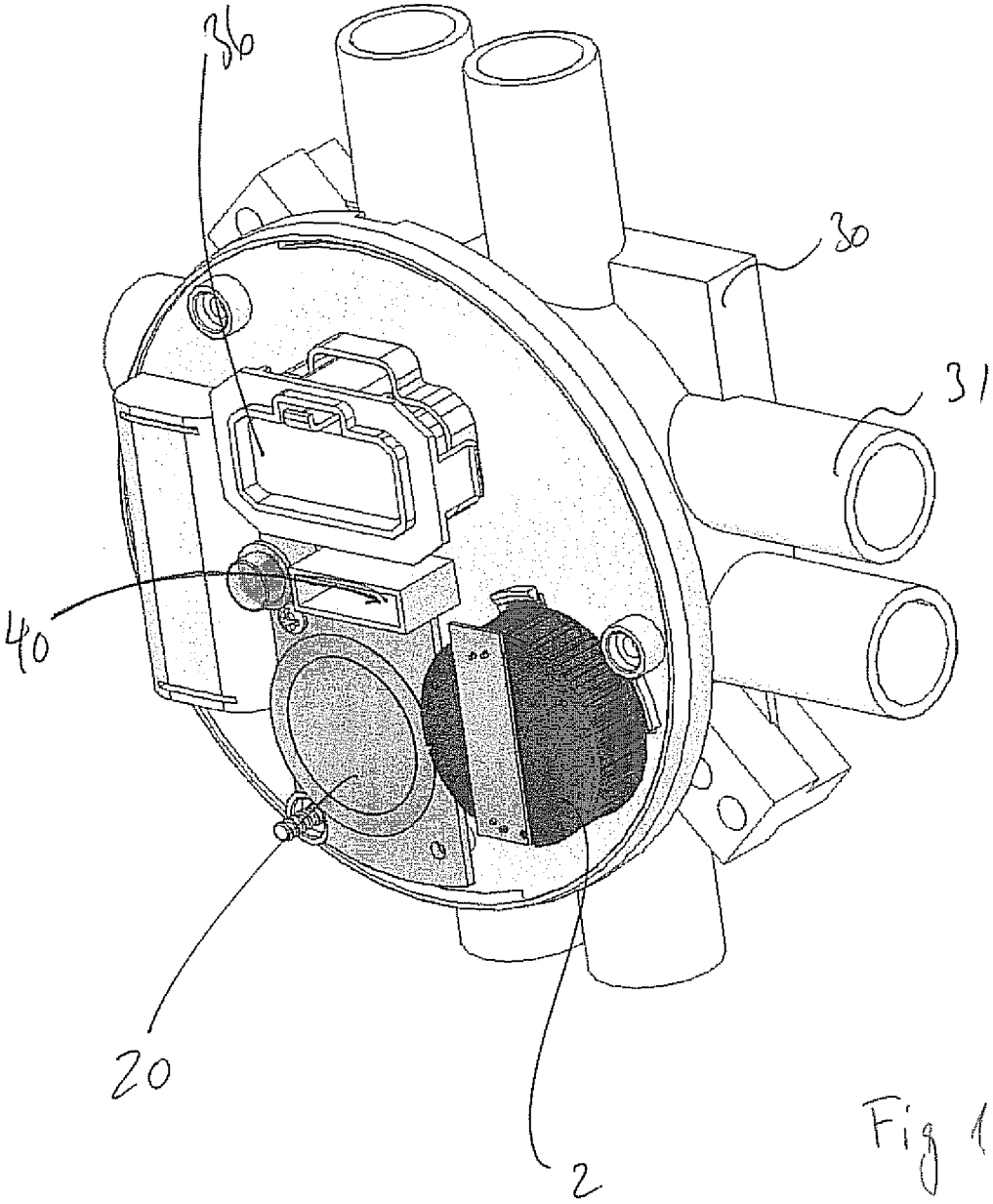
Figure 11:
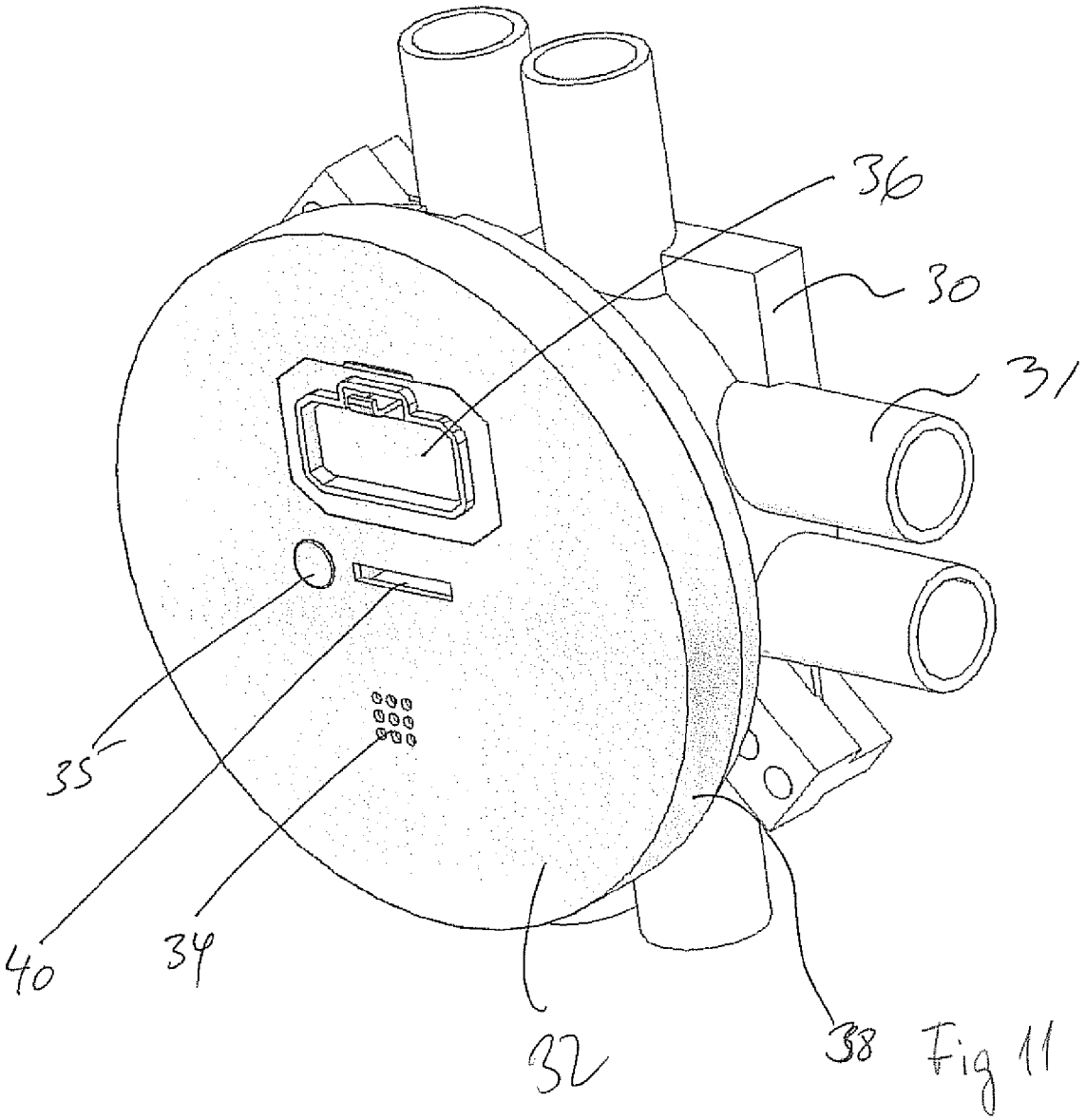

In the embodiment illustrated in FIGS. 10 and 11 a slit 40 is provided. This slit serves to allow a mechanical hanging of the device in order to take the load off the socket 34 should this be required.

The light fixture comprising an integrated smoke alarm may be utilising the electrical power present in the cable installation box, or be provided with a separate battery.

Furthermore the smoke detector and alarm may be an integrated part of the light fixture, or be shaped to resemble a light fixture, and be arranged on already existing light fixtures as a clip-on device.

The invention has now been explained with reference to various embodiments but it is clear that the scope of protection afforded to the present invention is only to be limited by the appended claims.

This report is intended to document the work carried out during stage 4 of the project to contribute to the design of a new smoke alarm for Travelsafe. This is intended to be (if possible) the smallest one commercially available.

During this stage the electronics and software were designed and developed, and a fully functional PCB of the correct size was prototyped. It was combined with SLA mechanical parts to enable complete prototypes to be produced. Tests on the smoke sensor and sounder performance were carried out.

This report includes a summary of the design work, details of some of the test results and some notes on mechanical design issues.

1.2 Test Methods

Most of the smoke sensor tests were carried out in the AW Technology 1400 smoke/heat detector test tunnel used for sales demonstrations and R&D work. This tunnel meets the requirements for testing to EN14604, the CEN standard for smoke alarms. This standard requires that a test aerosol generated from liquid paraffin is used, and that for optical detectors the concentration is measuring using a near infrared obscuration meter. In the tests the aerosol concentration was ramped up, and the concentration at alarm noted in units of dB/m.

2 Electronics and Software Design 2.1 Electronics Design

An initial PCB has been designed and tested. It generally works well. There were some component value changes required, mainly for the optical sensor gain and the sounder feedback. The following modifications will be required for the pre-production version:

Alignment slot to match mechanics.

Correct connection to photodiode.

Modify holes required to mount battery connectors

The sounder transformers need to be sampled and checked for function on the PCB.

2.2 Battery Capacity Calculation

The overall current consumption in non alarm has been calculated from the following components:

| Period (sec) | Action | Average current (μA) |
|---|---|---|
| 1 | 90 μS run time of micro at 1.2 mA | 0.1 |
| 8 | 3.08 mS run time of micro at 1.2 mA | 0.5 |
| 8 | 75 μS IR LED pulse at 0.5 A | 4.7 |
| 48 | 750 μS red LED pulse at 20 mA | 0.31 |
| 300 | 10 mA at 20 mA + micro run time | 0.8 |
| | TOTAL: | 6.41 |

If non-alarm current is 10 μA (worst case) for 10 years this takes 0.876 Ahr from battery.

Alarm current is approximately 40 mA on average. 10 hours alarm time takes 0.4 Ahr from battery.

Total of 10 years standby with 10 hours in alarm takes 1.276 Ahr from battery. A CR123A has a capacity of 1.4 to 1.6 Ahr, which is greater than the required capacity.

After a battery fault has been detected the fault 'pip' sound lasts for 13 mS (25 mA) every 48 seconds. A 30 day battery fault period takes 0.005 Ahr from the battery which should still be available after a fault has been detected.

2.3 Software

The software is complete and has been tested. Further minor modifications may be needed but do not affect the tooling for the product.

3 Smoke Sensor Performance 3.1 Sensitivity and Standing Signal

The sensitivity was hard to measure as the optical sensor readings were very noisy when the prototype was connected to a PC using the USB debug interface. When an oscilloscope was connected to observe the optical pulse signs the readings were stable, which indicates that the noise was due to ground effects through the PC.

Following initial tests the electronics gain has been adjusted so that the slope gain of optsig is at the target 200 bits/dB/m at the nominal optgain of 128.

The calibration procedure (in TSV1/302) was tested by powering the prototype with the CALIB pin set to 0V, in the AW Technology tunnel at 0.25 dB/m and then in clean air. The procedure appears to work, and further tests are required with samples from the pre-production batch.

The standing signal was measured between 0.25 and 0.30 dB/m. This is higher than the initial target, but is a lot lower than the current Cavius product and other smoke alarm units in production. To achieve this further modifications are required to the chamber mouldings:

A 2 mm long vane to be added next to the photodiode aperture.

Better overlap between the two chamber parts around the LED and photodiode housings.

Sharper vane features, particularly those opposite the LED and photodiode.

Frosted top and bottom inner faces to chamber, but do not decrease effective height of chamber (indents within current wall thickness).

Care is needed with the material selection and finish for the chamber mouldings. The black colour should be carbon black rather than dye, and there should be a fine matt finish to these parts.

Temperature tests are required at 0° C. and 55° C. These should be carried out with pre-production samples as they will be more representative, and if there is a problem the temperature compensation can be adjusted in the software.

3.2 Smoke Entry

In EN14604 the smoke entry is tested by measuring the sensitivity when the airflow is at different directions at 0.2 m/s, and by comparing the sensitivity at 0.2 m/s and 1.0 m/s. In these tests the performance of the insect screen is critical and a sample of the foil screen was used. These tests were carried out on a complete prototype, but without the case moulding as the battery did not fit (see below). The 0 degree orientation was with the LED downstream.

The results of the directional dependence test at 0.2 m/s were:

| Orientation (degrees) | Sensitivity (V/dB/m) |
|---|---|
| 0 | 0.144 |
| 45 | 0.133 |
| 90 | 0.153 |
| 135 | 0.147 |
| 180 | 0.138 |
| 225 | 0.144 |
| 270 | 0.124 |
| 315 | 0.158 |

The ratio between the most and least sensitive readings is 1.27. This is much less than the 1.6 limit in EN14604 and should ensure a good pass.

For the air movement test the sensitivity is again measured at the most and least sensitive orientations at 1.0 m/s. The results were:

| Orientation (degrees) | Sensitivity (V/dB/m) |
|---|---|
| 270 | 0.127 |
| 315 | 0.129 |

For this tests the ratio between the sum of the readings at each airspeed is calculated. For these results the calculation is (0.158+0.124)/(0.129+0.127)=1.10. This is much less than the 1.6 limit in EN14604 and indicates that there is very good smoke entry at 0.2 m/s.

3.3 Ambient Light

The dazzle test specified in EN54-7 is not possible within the tunnel at AW technology as the 30W 30 cm diameter lamps will not fit within it. A test was carried out with a 22W 20 cm diameter lamp places approximately 10 cm from the inlet vanes of a working prototype. The signal from the chamber did not change by more than about 4 bits which is a small shift compared with the 24 bit alarm threshold. This indicates that the smoke alarm will not false alarm or significant change sensitivity in the dazzle test. The prototype was fitted with an insect screen, will reduce the effect of external light so should pass in approvals tests.

4 Sounder

Many tests were carried out on sample iezo sounder disks mounted into SLA top mouldings which were supplied complete to AW Technology. The main findings and observations from this work are:

- During the software development the sound pattern was change to the 'T3' pattern of 30.5 second on periods followed by a 1.5 second off period. This is as specified in UL and Australian standards, and can be used for EN approvals.
- The output from the feedback electrode did not increase greatly near resonance (frequency with greatest sound output). It was thought to be because the mounting diameter was not at 66% of the diameter, but this was found not to be the case. With the second set of 6 samples all 6 did tune into resonance automatically and give a good sound output.
- Each time the smoke alarm is powered up (battery fitted) the sounder will take up to 60 seconds to automatically tune into resonance. If there are problems with subsequent batches the software may need to be modified.
- Tests were carried out with the hole in the top part increased in size. Increasing the hole diameter from 4 to 6 mm increased the sound output by about 3 to 4 dBA.

Great care had to be taken when increasing the hole size as in many cases the mounting of the piezo was disturbed and the sounder would not find the resonant frequency.

- Tests were carried out with 27 mm and 32 mm diameter piezo disks. The 32 mm disks were about 1 dBA louder. The use of 32 mm diameter disks with a 6 mm diameter hole in the top moulding is recommended unless a better combination can be found.
- Most comparative tests were carried out in the laboratory and up to 92 dBA was achieved at 3 m. Tests outdoors indicated about 87 to 88 dBA at 3 m, which is greater than the 85 dBA required in EN14604. Tests were carried out on the fast setting, with 'Max' selected as specified in the standard.
- With the supplied voltage reduced to 2.65V (low battery indication) the sound output decreased by 1 to 2 dBA. As the 85 dBA has to be achieved in this state the smoke alarm sounder should pass, but be close to the limit. All samples need to be checked before they are sent for approvals testing.
- The electronic circuit and software are capable of achieving a much greater output, as when the PCB is connected to a piezo mounted in another smoke alarm (much larger cavity) the sound output increased by about 6 dBA, which would make it easily pass the requirements in EN14604. Any efforts to increase the sound output therefore involve the mechanical design and piezo selection, which are outside of the scope of the AW Technology stage 4.

5 Overall Design

The following issues were noted with the mechanical design.

- The main case fits into the base with an anti-clockwise twist. It is more conventional to use a clockwise twist. This had been fixed before it was reported by AW Technology.
- The button does not fit well in the slot in the case. This may be due to the SLA model, but may need attention.
- Larger features are needed at the base of the button lever arm. The ones in the model look too weak.
- The action of the button on the PCB switch needs attention. It worked in the initial prototype sent to New Zealand, but needed to be pressed the right place to operate. The location of the PCB switch is critical for this. Features may be needed to absorb some of the force to prevent the PCB switch from being dislodged.
- When the battery is fitted between the battery connector springs the assembly does not fit easily within the case moulding. Some adjustment of the design may be required in this area.

The invention has now been explained with reference to various embodiments, but it is clear that the scope of protection afforded to the present invention is only to be limited by the appended claims.

The invention claimed is:

1. Smoke alarm comprising at least one internal chamber, which chamber has at least one opening towards the surroundings, such that air and smoke pass through the chamber, and where means are provided for emitting light and means for detecting said light is provided in or around said chamber, where the change in light intensity registered by the means for detecting generates a smoke alarm, by means of a noise and/or light generating means, wherein the internal chamber is substantially circular, and that the light emitting means are arranged at an angle to the light detecting source, and that along the periphery of the chamber a plurality of air foils are arranged, where the airfoils substantially have a cross-sectional shape corresponding to an airplane wing, and where said airfoils are arranged at an angle relative to an imaginary radius of the internal chamber.

2. Smoke alarm according to claim 1, wherein an internal wall is provided in the internal chamber, where at least a portion of said wall obstructs a direct line between the light emitting means and the light detection means.

3. Smoke alarm according to claim 1, wherein the smoke alarm comprises an outer housing, which outer housing comprises a lower housing, said lower housing defining a battery compartment, inside which a source of energy is stored, and an intermediate housing, where the wall of said intermediate housing comprises a plurality of openings allowing air and smoke to enter the internal chamber, and a top housing portion, where separating the battery compartment and the internal chamber one or more PCB's are arranged containing necessary electronic circuitry and light emitting and detection means projecting into the internal chamber, and where the internal chamber is limited towards the top housing portion by a plate member from which plate member the airfoils project towards the PCB, and where on said plate member away from the internal chamber a piezo electrical sound element is arranged, where apertures are provided in said plate member allowing the sound from the piezo electric sound element to propagate to the surroundings through said internal chamber and said wall of the intermediate housing.

4. Smoke alarm according to claim 1, wherein the housing is circular cylindrical, and that the outer dimensions of the housing/circle diameter is approx. 40 mm and the cylinder height is between 38 to 45 mm.

5. Smoke alarm according to claim 1, wherein the smoke alarm is integrated in an electrical outlet for a light fixture, and in particular a light fixture suitable to be mounted in a ceiling or other surface from which electrical equipment and in particular lamps are suspended, where said internal chamber, said noise and/or light generating means, and electronic circuitry are arranged surrounding the electrical wire connecting the electrical outlet to an electrical fixture.

6. Smoke alarm according to claim 5, wherein means for mechanically attaching an electrical fixture to said smoke alarm is provided, where said means for attaching is a hook, a ring, a clamp or any other mechanical attachment.

7. Smoke alarm according to claim 5, wherein the smoke alarm is integrated and housed inside the electrical outlet's covering, where the covering is provided with one or more openings allowing air and smoke to pass the covering and enter the internal chamber.

8. Smoke alarm according to claim 1, wherein the smoke alarm is arranged inside a housing, where said housing has an outer shape substantially corresponding to an electrical ceiling light fixture, where the housing is provided with a through-going aperture, allowing an electrical wire to pass through substantially the centre of said housing.

9. Smoke alarm according to claim 5, where said electrical outlet for a fixture comprises:

a lower housing part having a bottom surrounded by a circumferential upstanding wall, where said bottom has means for attaching said housing to a cable installation box, a source of energy arranged inside said lower housing and a PCB containing necessary electronic circuitry, arranged in combination with said internal chamber, a piezo electric alarm element is arranged for generating a smoke alarm, where on top of the lower housing part connected to said lower housing part and enclosing the smoke chamber and the alarm element is provided a cap where a plurality of apertures or a mesh is provided in said cap, and where the lower housing part and the cap is provided with a superposed opening, allowing the electrical wire connected to a lamp or other suspended article to pass through the smoke alarm.

* * * * *